US006669022B2

(12) United States Patent
Donegan

(10) Patent No.: US 6,669,022 B2
(45) Date of Patent: Dec. 30, 2003

(54) ROTATABLE COMPACT CASE WITH NON-REMOVABLE PILL PACKAGE INSERT

(75) Inventor: Michael Patrick Donegan, Williamstown, NJ (US)

(73) Assignee: Comar, Inc., Buena, NJ (US)

( * ) Notice: Subject to any disclaimer, the term of this patent is extended or adjusted under 35 U.S.C. 154(b) by 0 days.

(21) Appl. No.: 10/101,000

(22) Filed: Mar. 19, 2002

(65) Prior Publication Data

US 2002/0166791 A1 Nov. 14, 2002

Related U.S. Application Data

(60) Provisional application No. 60/277,362, filed on Mar. 20, 2001.

(51) Int. Cl.[7] ..... B65D 83/04
(52) U.S. Cl. ..... 206/531; 206/533
(58) Field of Search ..... 206/531, 533, 206/536; 221/87

(56) References Cited

U.S. PATENT DOCUMENTS 4,778,054 A * 10/1988 Newell et al. ..... 206/531

6,325,241 B1 * 12/2001 Garde et al. ..... 221/87

* cited by examiner

*Primary Examiner*—David T. Fidei
(74) *Attorney, Agent, or Firm*—Eugene E. Renz, Jr.

(57) ABSTRACT

A child resistant pill package assembly comprising a base member and a top member spaced apart to define a hollow interior. A dial is mounted on a platform for an annular pill pack assembly having a lower portion. The dial projects through an opening in the top. A plurality of radially outwardly circumferentially spaced teeth are formed on the lower portion of the dial. A series of complementary teeth which project radially inwardly from the circular opening in the top and mesh with the teeth on the lower portion of the dial when aligned therewith. Flexible spring fingers normally bias the dial outwardly so that the dial teeth and top teeth are in meshing relationship. Application of pressure on the dial downwardly displaces the spring fingers so that the teeth are disengaged and confront the upper portion to permit rotation of the dial and pill pack.

2 Claims, 11 Drawing Sheets

ROTATABLE COMPACT CASE WITH NON-REMOVABLE PILL PACKAGE INSERT

This application claims the benefit of U.S. Provisional Application No. 60/277,362 filed Mar. 20, 2001.

FIELD OF THE INVENTION

The present invention relates to a package for pill-type medicaments which is child resistant and wherein the pill package is locked in the package for one-time use and in that fashion is not accessible to unauthorized removal of pills by, for example, children.

BACKGROUND OF THE INVENTION

Rotary pilled dispensing package of the type to which the present invention relates are not new per se. They typically comprise a housing for a so-called blister pill pack and means for advancing pills one at a time to a discharge position in the housing.

SUMMARY OF THE INVENTION

The present invention is an improvement over the prior art which is characterized by novel features of construction and arrangement including a relatively simplified housing which is easy and economical to manufacture and a novel child resistant means aimed at preventing children below a certain age from manipulating the device to discharge the pill medicaments. To this end the pill package assembly comprises a generally circular saucer like top and a complementary base which are easy and economical to mold out of conventional plastic materials and are provided with means for snap fitting the top to the base, and an annular blister pack ring for the pill medicaments. The assembly also includes a dial which in the preferred embodiment is of stepped configuration having a lower portion with series of axially extending teeth around its periphery and a top portion of smaller diameter or cross section. The dial projects upwardly through an opening in the top. The periphery of the opening is formed with a series of circumferentially spaced teeth which mesh with the teeth in the lower portion of the dial. The dial is mounted on an annular platform having a series of pegs which engage and locate an annular ring like blister pack on the platform surrounding the dial.

Accordingly, the dial can be rotated to selectively present individual pills in the annular array at a discharge station where one pill at a time may be dispensed by the user. Spring fingers on the base of the platform normally bias the dial to an upper position wherein a circular array of teeth in the opening in the top of the housing mesh with the dial teeth thereby preventing rotation of the dial and in this manner provide a means for preventing children from tampering with the package assembly and rotating the dial to facilitate discharging the contents of the pill package. When an adult user wishes to rotate the pill pack to present a pill at the discharge station, the dial is pressed inwardly against the bias of the spring fingers so that the top housing teeth are now displaced to a position where they confront the upper portion of the dial. In this position, the dial can be freely rotated since the upper portion of the dial is of a diamter smaller than a circular trace through the tips of the top housing teeth. Of course, when the axially applied pressure on the dial is released, the dial springs upwardly to its normal position wherein the teeth in the top are intermeshed with the teeth in the lower portion of the dial and the child resistant feature is operative.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 1A:
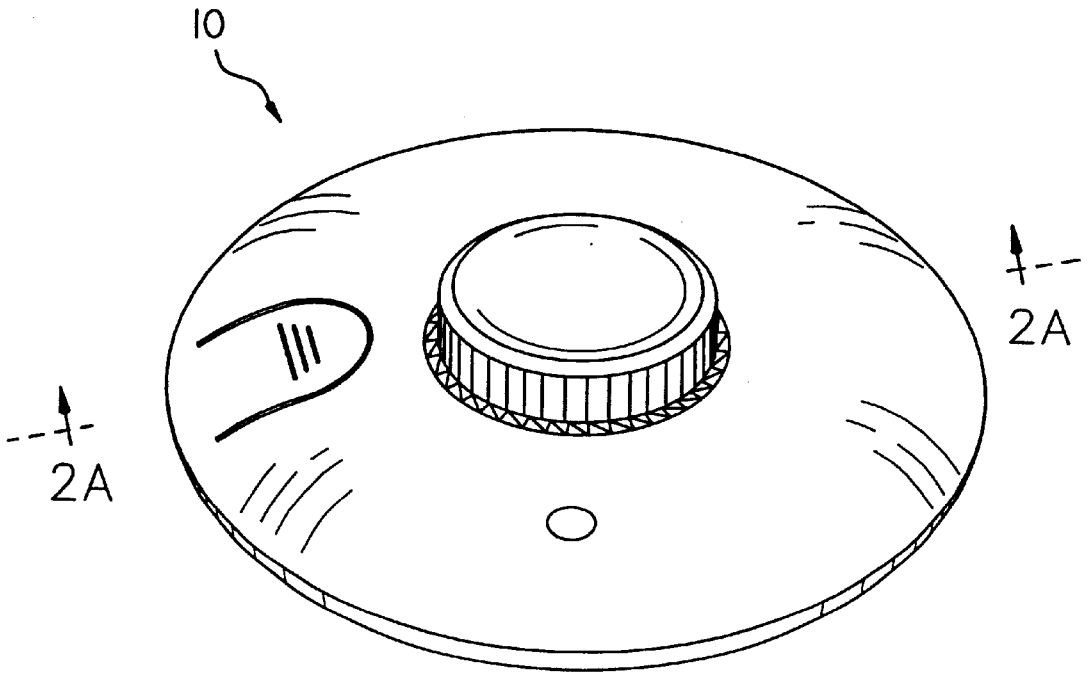
FIG. 1A is a perspective view of a medicament pill dispenser in accordance with the present invention.
Figure 1B:
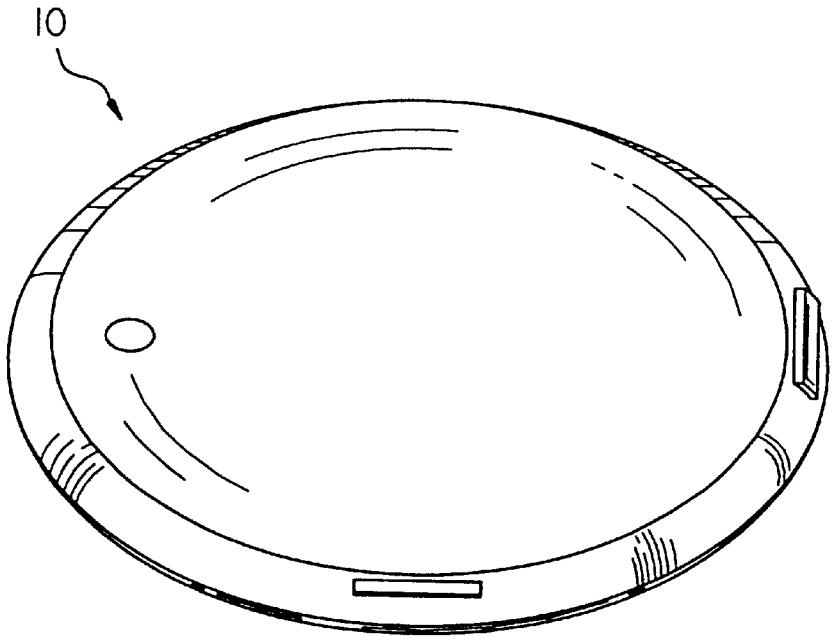
FIG. 1B is a bottom perspective view of the case.
Figure 2A:
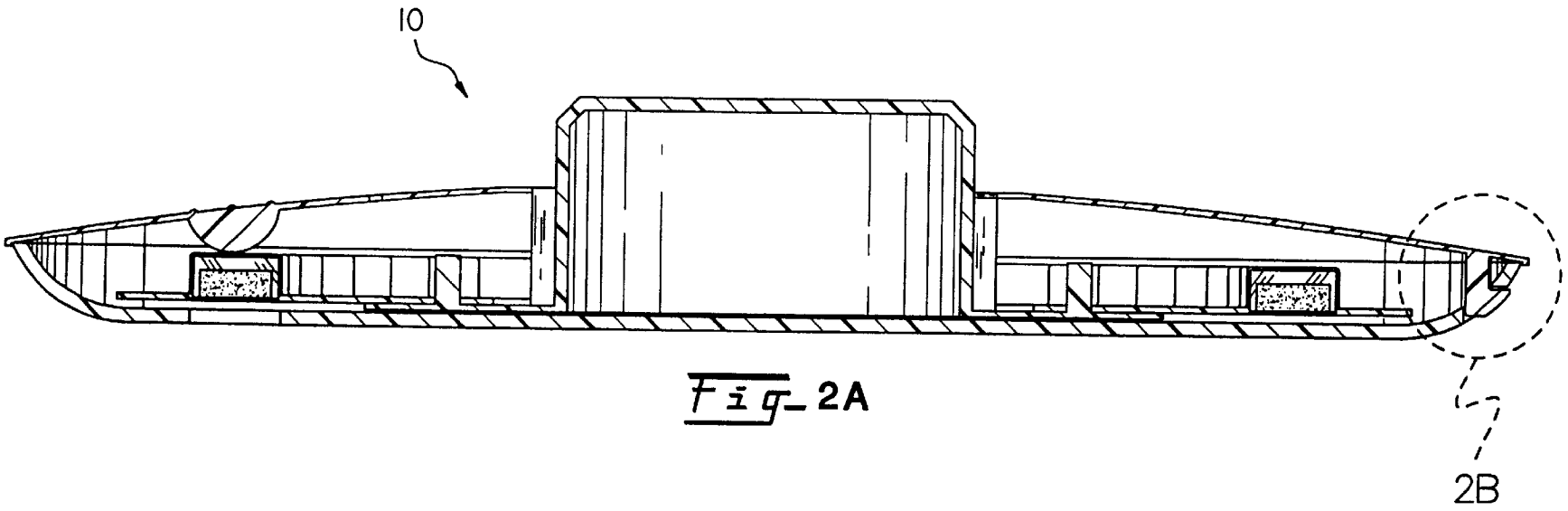
FIG. 2A is an enlarged transverse sectional view taken on lines 2A—2A of FIG. 1A.
Figure 2B:
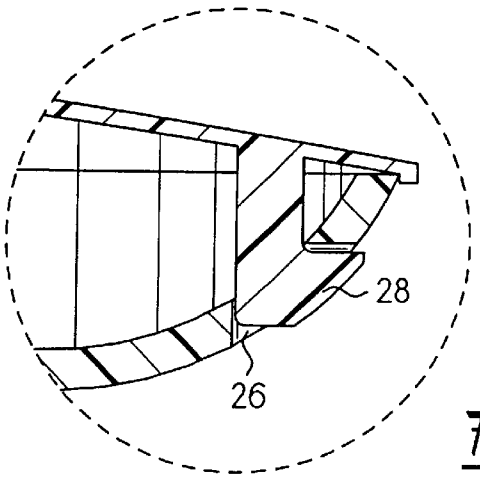
FIG. 2B is an enlarged fragmentary view showing the locking means for the halves of the case shown in broken lines in FIG. 2A.
Figure 3:
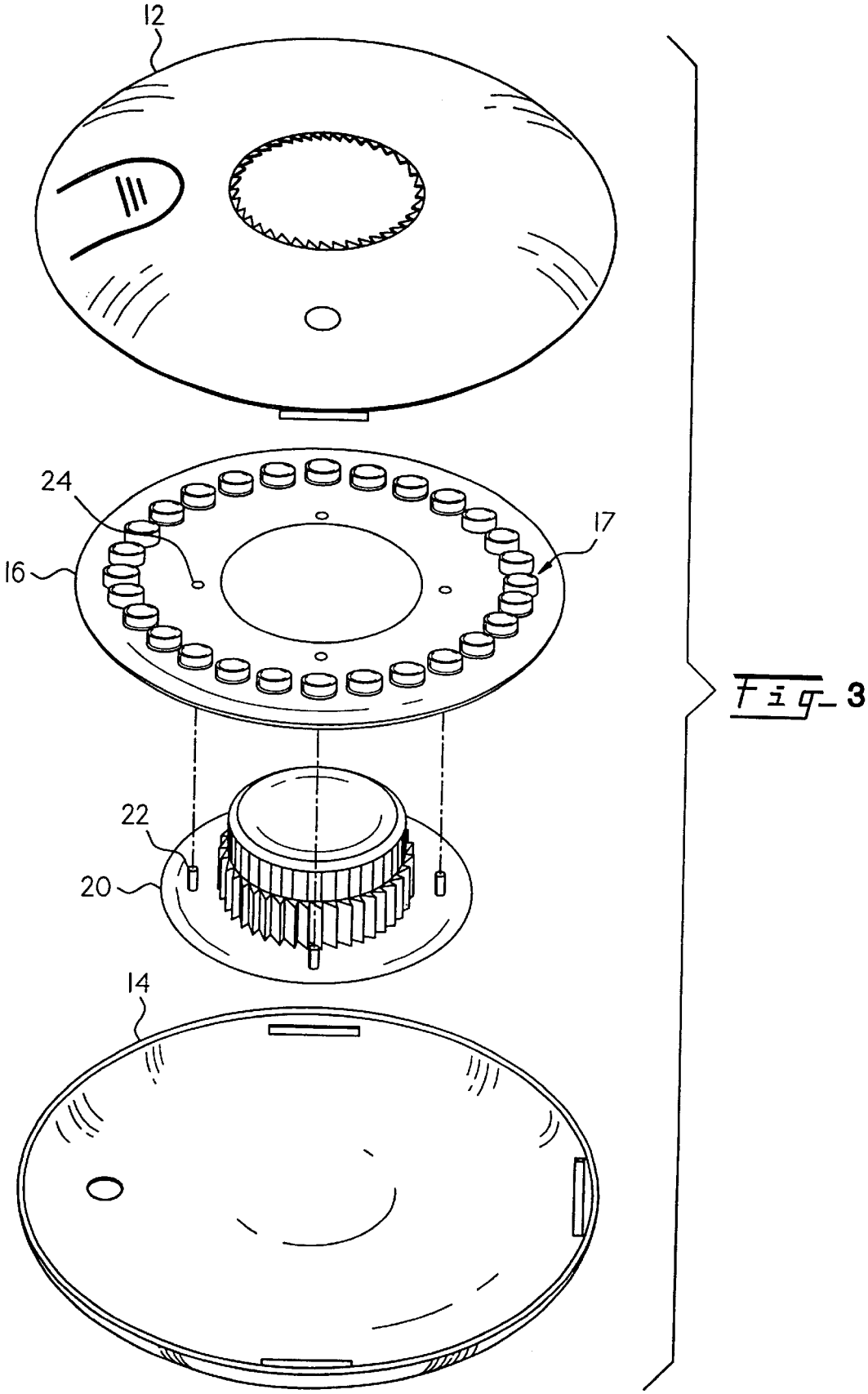
FIG. 3 is an exploded perspective view of the component of the pill dispensing case.
Figure 4A:
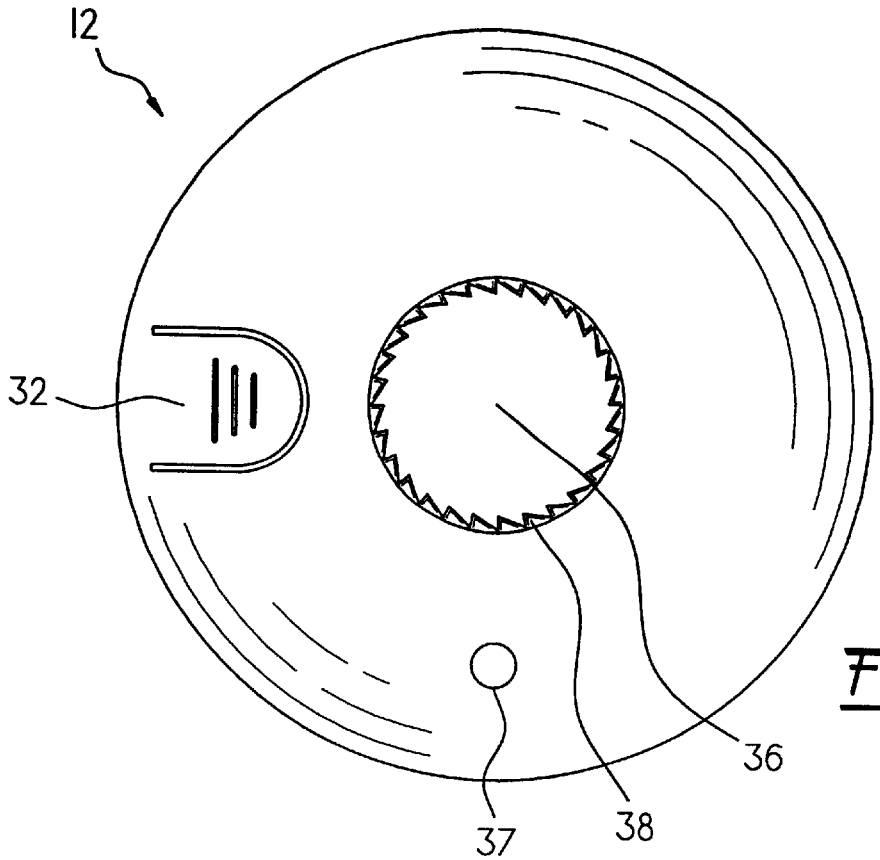
FIG. 4A is a top plan view of the top of the case.
Figure 4B:
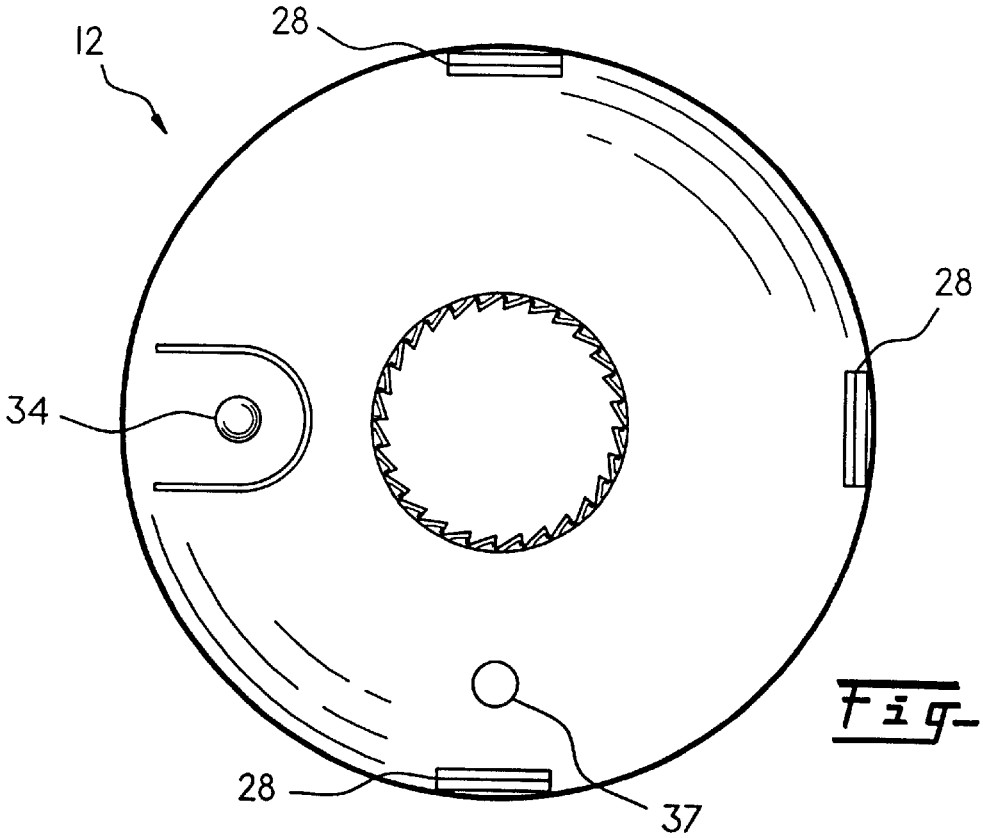
FIG. 4B is a bottom plan view of the top of the case.
Figure 5A:
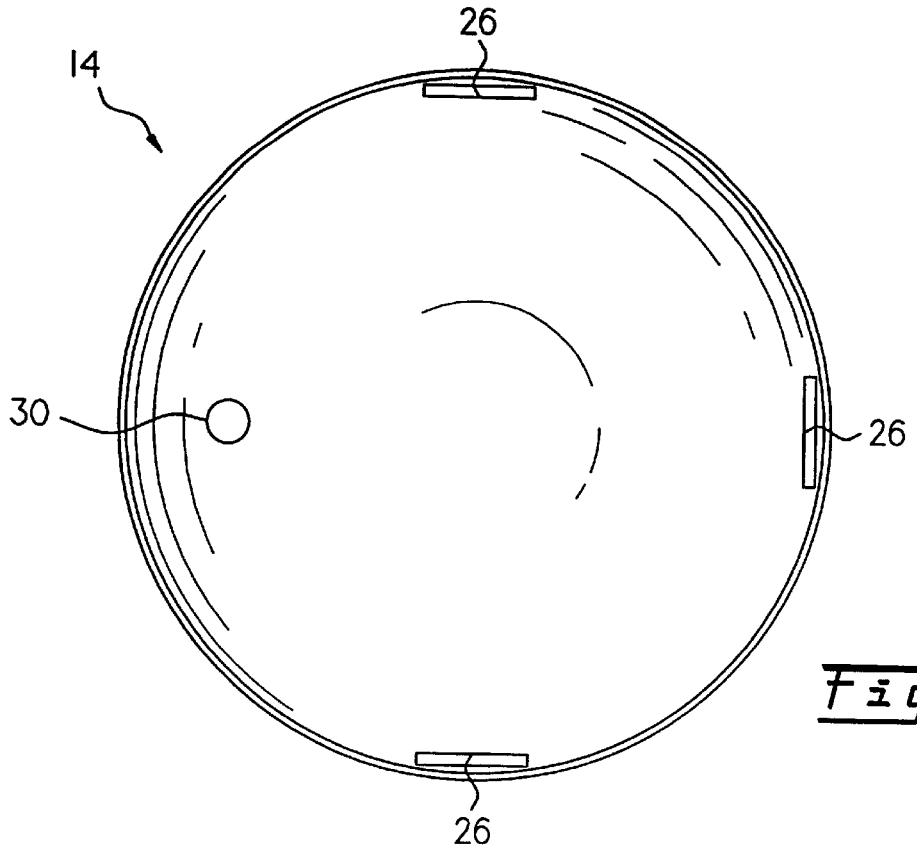
FIG. 5A is a top plan view of the base of the case.
Figure 5B:
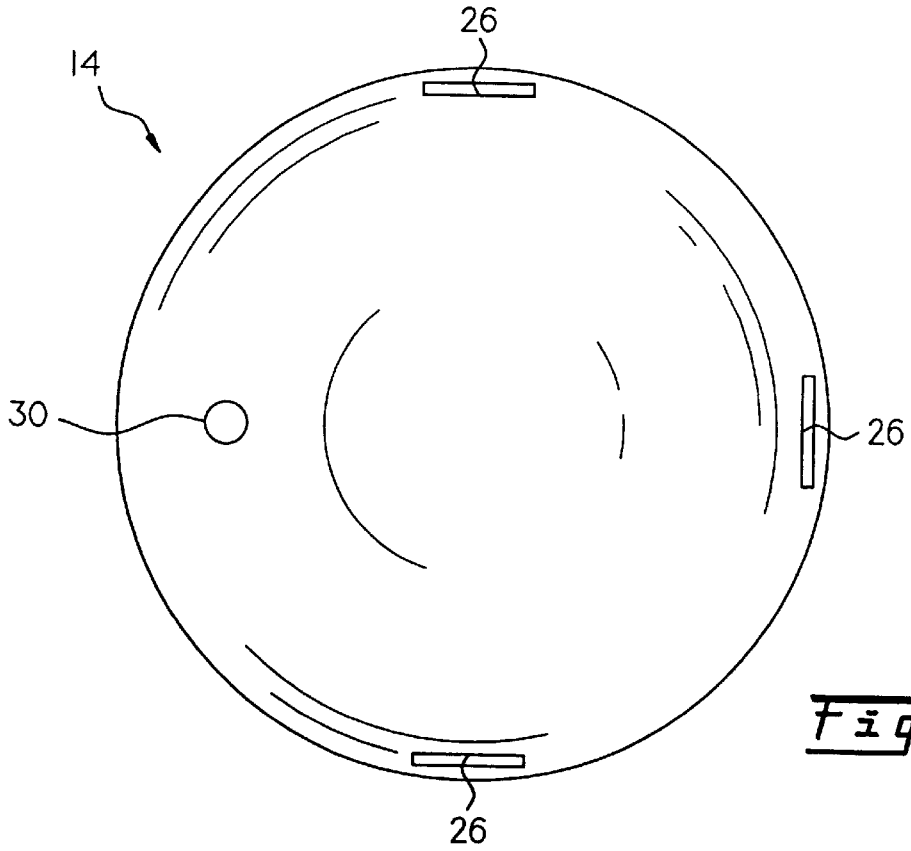
FIG. 5B is a bottom plan view of the base of the case.
Figure 6A:
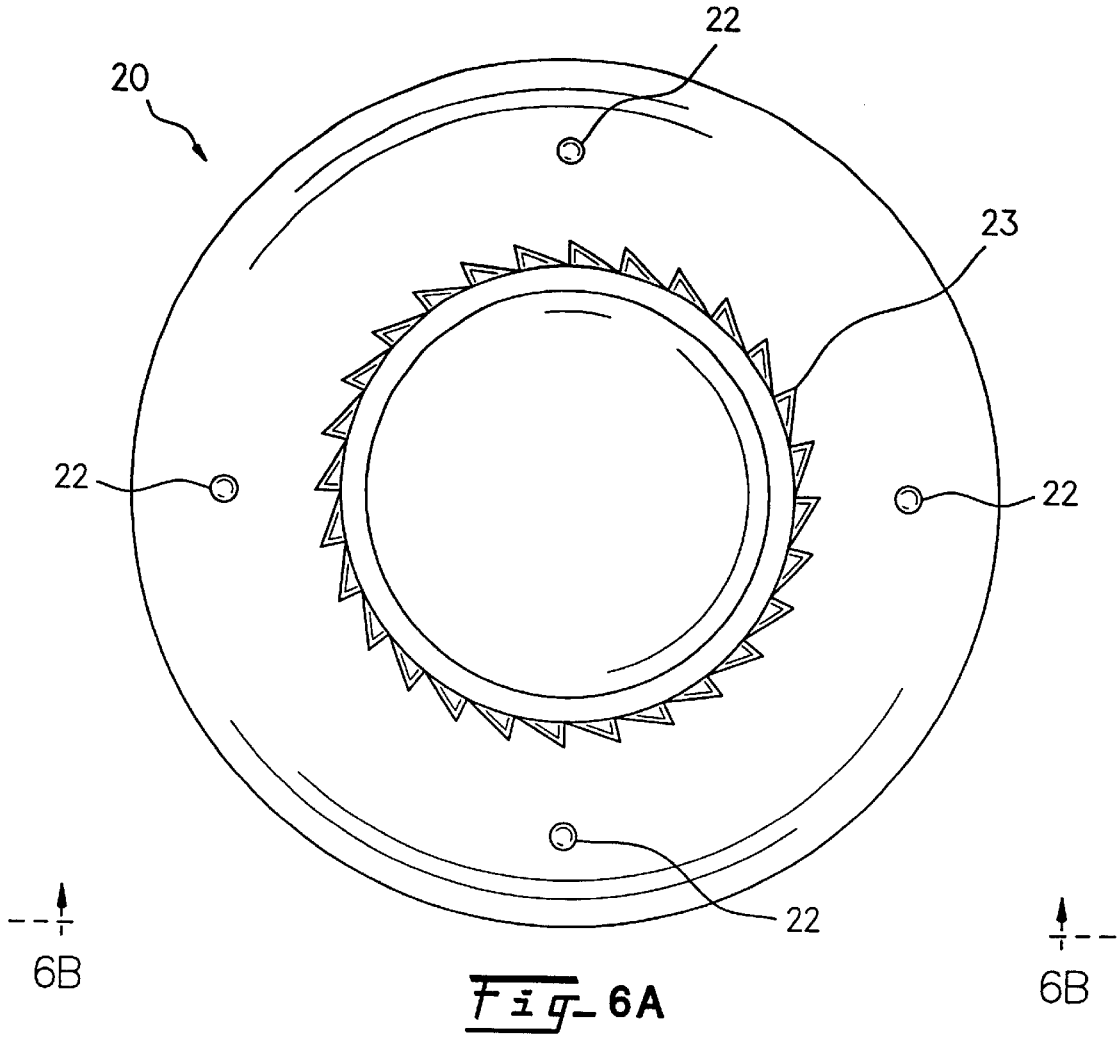
FIG. 6A is a top plan view showing dial teeth.
Figure 6B:
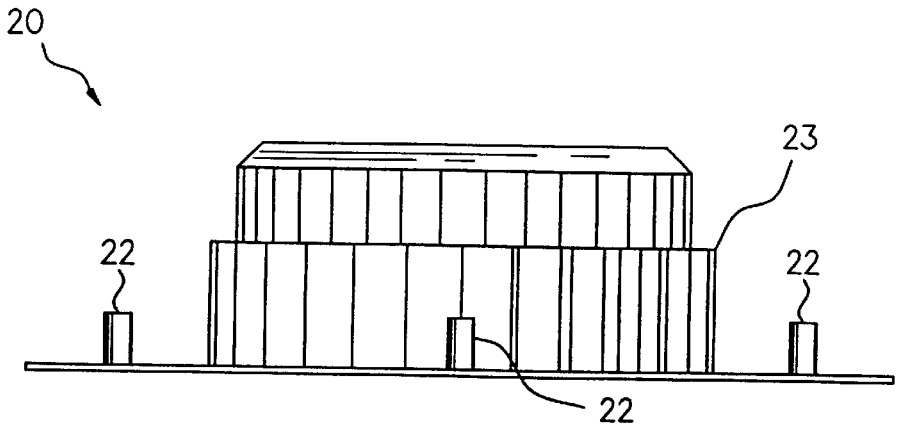
FIG. 6B is a side elevational view as viewed from lines 6B—6B of FIG. 6A.

Referring now to the drawings and particularly to FIGS. 1–3 thereof, there is shown a non-removable pill package assembly in accordance with the present invention which is generally designated by the numeral 10. The basic components of the package are best shown in FIGS. 3 and comprise a circular saucer-like top (12), a complementary base (14) and housed within the top (12) and base (14) is an annular blister pack ring (16) for the pill medicaments to be dispensed. The package includes a dial (20) having a series of locating pegs (22) which engage through complementary openings in the pill pack ring (24). The top (12) and base (14) in the present instance are held together by a slot (26) and latch (28) arrangement comprising, in the present instance a series of three elongated slots (26) in the base (14) and a series of depending lugs (28) equi-spaced on the top (12) to register with the slots (26) in the base (14) to lock the parts together in the manner shown in FIG. 2A, for example.

It is noted that the lug (28) seats in the slots (26) in a manner preventing disassembly once the parts are engaged without destroying or giving some indica or evidence that the parts have been tampered with.

Figure 7A:
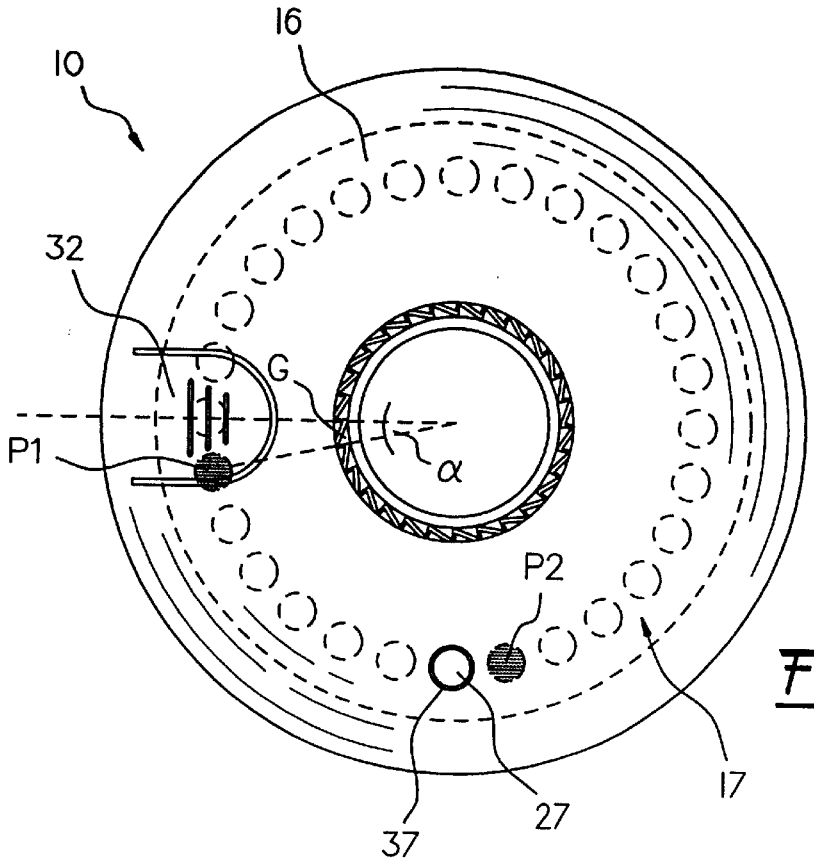
FIG. 7A is a top plan view showing the angular displacement between the pills and the dial.
Figure 7B:
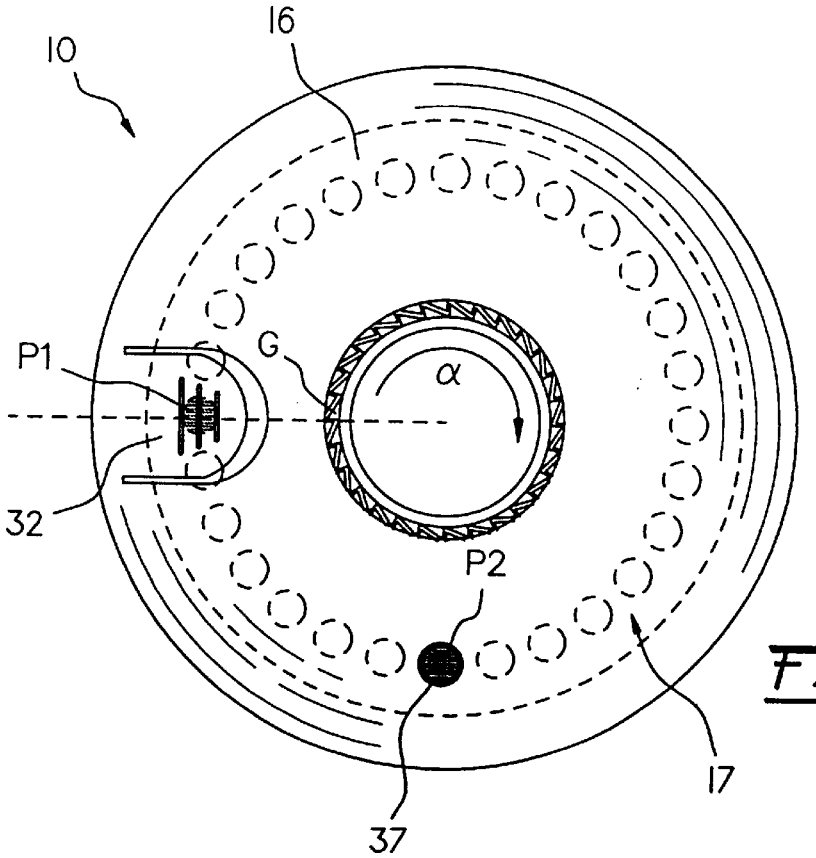
FIG. 7B is a is a view similar to FIG. 7A with the dial advanced.

The base (14) has a circular discharge opening (30) and the top (12) has a finger press cut-out (32) with a spherical projection (34) aligned with the circular array (17) of pills so that when the pill ring (16) is rotated, the blister pack (27) registers with the discharge opening (30) in the manner shown, for example, in FIGS. 7A and 7B.

The top (12) has a central enlarged opening (36) defining a series of circumferentially extending equi-spaced teeth (38) which mesh with teeth (23) on the dial (20).

With reference to 7A and 7B, the teeth are of a predetermined angular configuration so that for each incremental rotation of the dial (20) to a new meshing relationship with the teeth (38) and the top (12), the pill ring (16) is advanced one complete position so that a pill is always presented in the proper position to be dispensed at the thumb punch location (32).

Figure 8A:
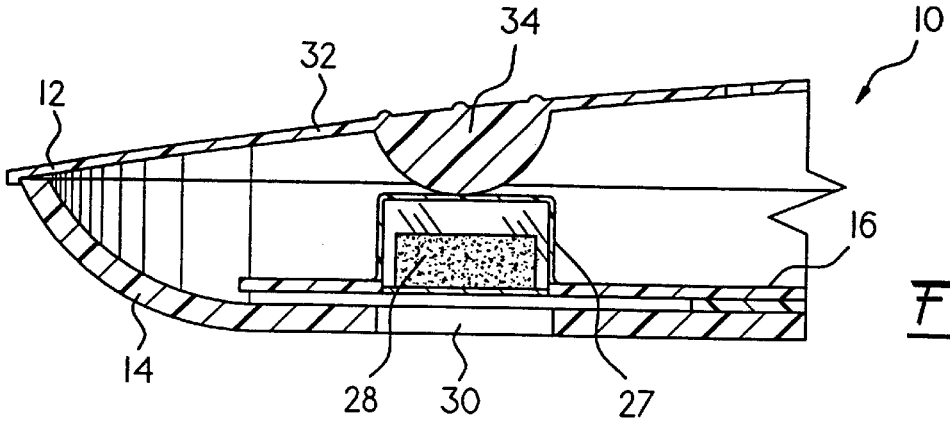
FIGS. 8A–8C, inclusive, are fragmentary sectional views showing the pill dispensing operation.
Figure 8B:
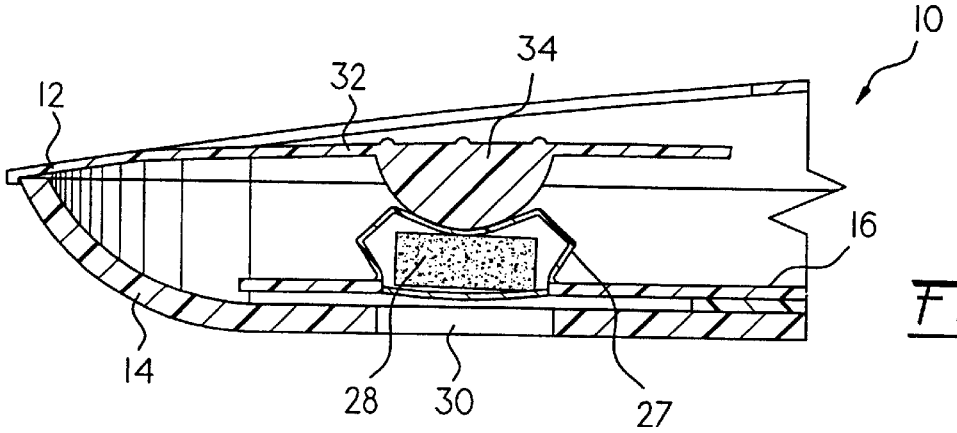
Figure 8C:
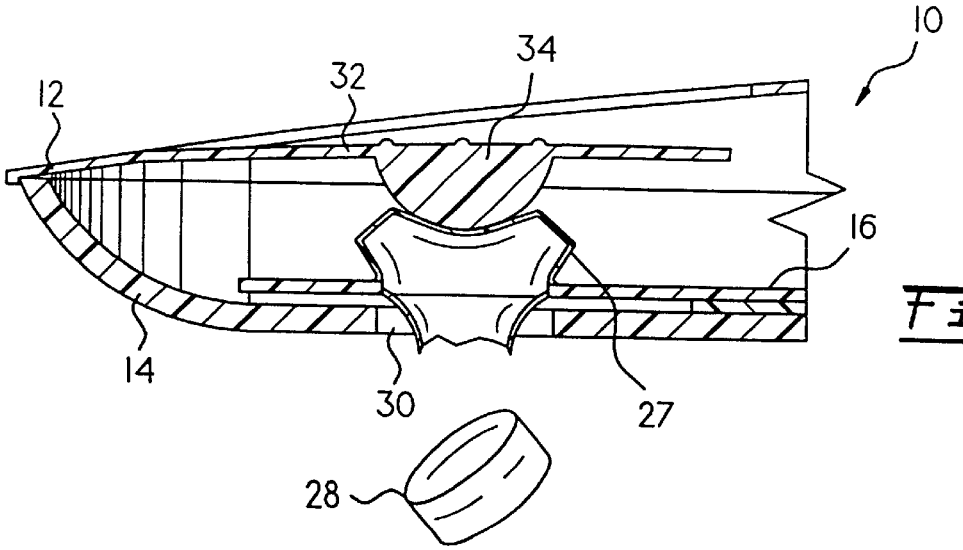

FIGS. 8A–8C, inclusively, show the interior projection (34) of the thumb punch engaging the pill pack (27) at a location to press it through the pill ring (16).

Figure 9A:
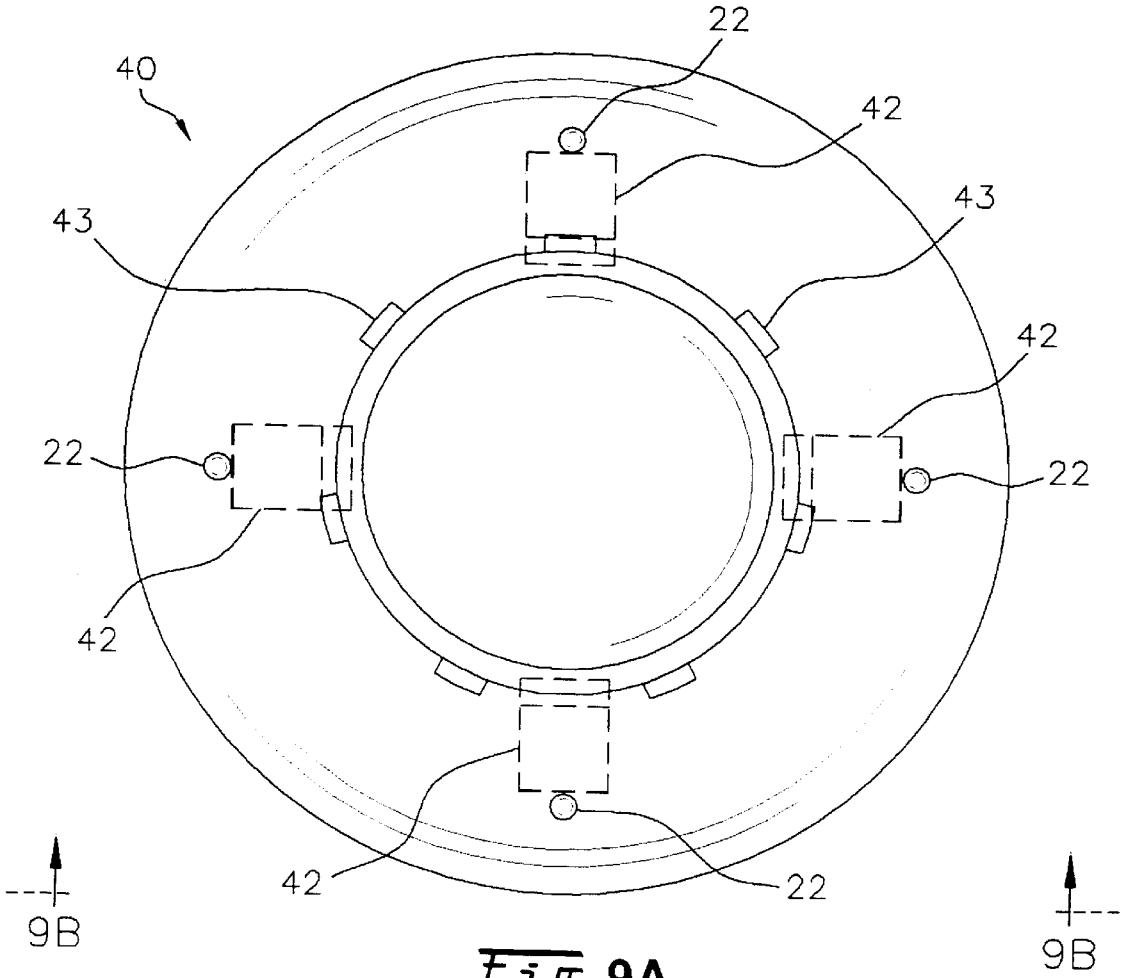
FIG. 9A is a top plan view of an alternate embodiment of the dial.
Figure 10:
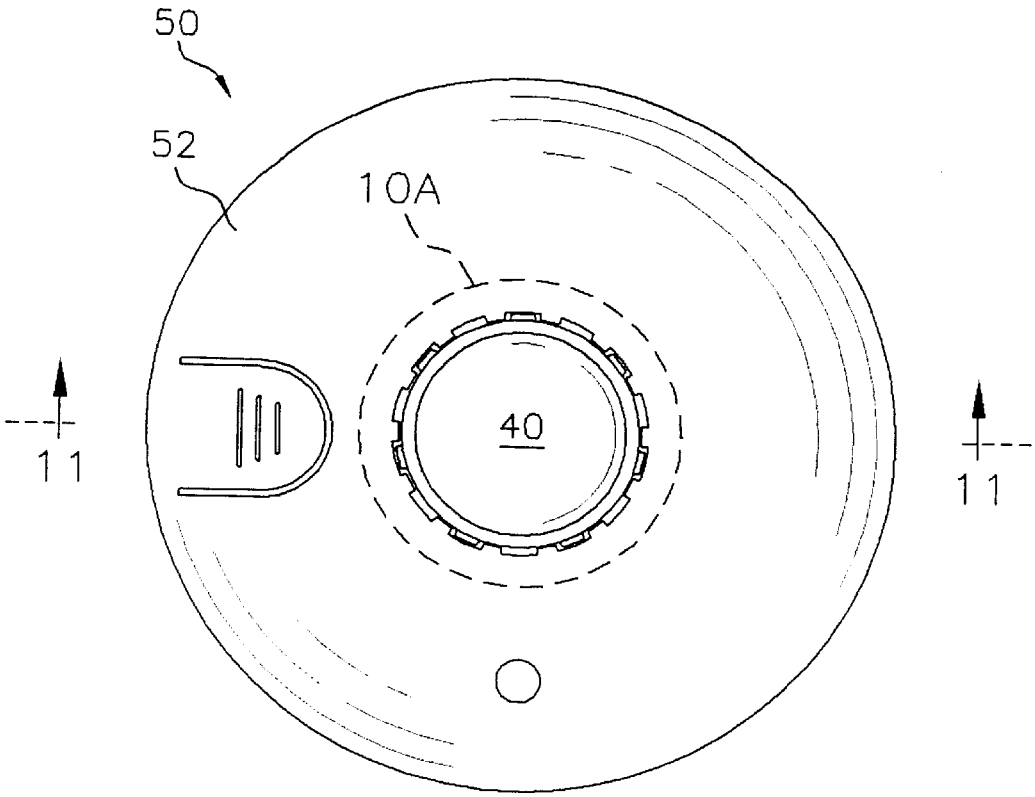
FIG. 10 is a top plan view of an alternate embodiment of the pill dispensing case.
Figure 10A:
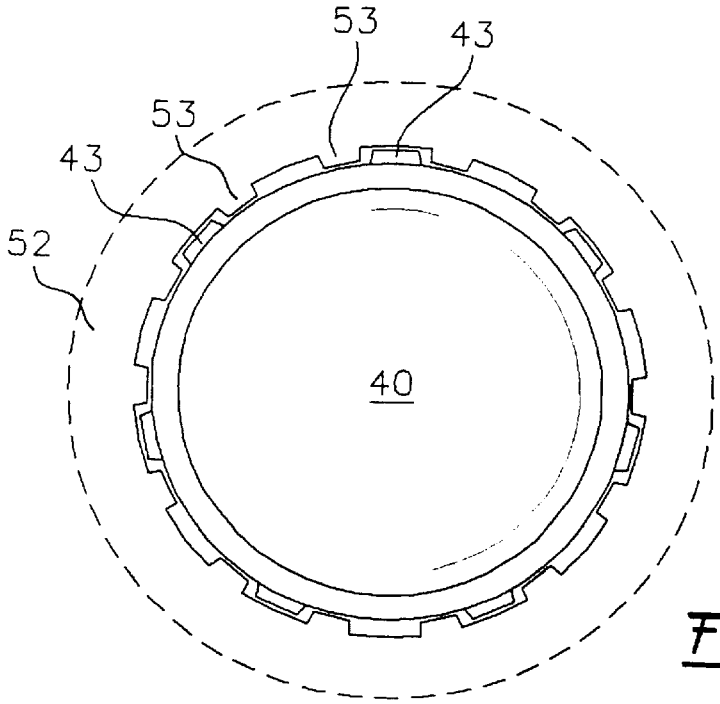
FIG. 10A is a detailed view of the alternate embodiment of the pill dispensing case taken from dashed lines 10A of FIG. 10.

FIG. 9A shows a top plan view of an alternate embodiment of a dial (40). Dial (40) has a series of circumferentially extending, equi-spaced teeth (43). The teeth (43) engage with a series of opposing circumferentially extending equi-spaced teeth (53) on an alternate embodiment top (52). The dial teeth (43) cooperate with top teeth (53) to prevent unintentional turning of the dial (40) by an infant or child as shown in FIGS. 10 and 10A.

Figure 9B:
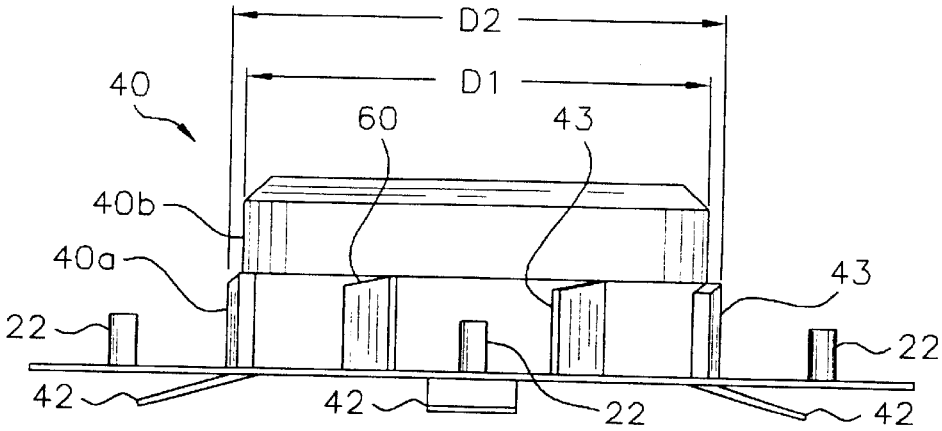
FIG. 9B is a side elevational view as viewed from lines 98—98 of FIG. 9A.

As shown in FIGS. 9A and 9B, the dial (40) has a series of circumferentially equi-spaced spring-like fingers (42). As shown sequentially in FIGS. 11 and 12 by depressing the dial (40) the fingers (42) are compressed, disengaging the dial teeth (43) from the top teeth (53) thereby allowing the user to turn dial (40). Upon releasing the dial (40) the fingers (42) return to their original position thereby lifting dial (40) and engaging teeth (43) with top teeth (53) to prevent turning of the dial (40).

Figure 11:
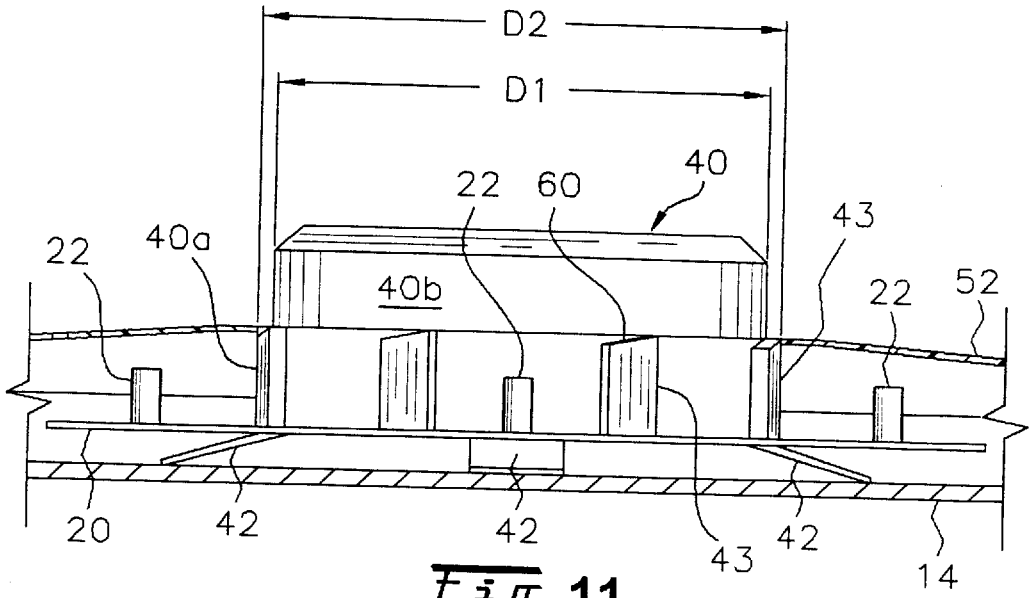
FIG. 11 is an enlarged fragmentary sectional view taken along lines 11—11 of FIG. 10.
Figure 12:
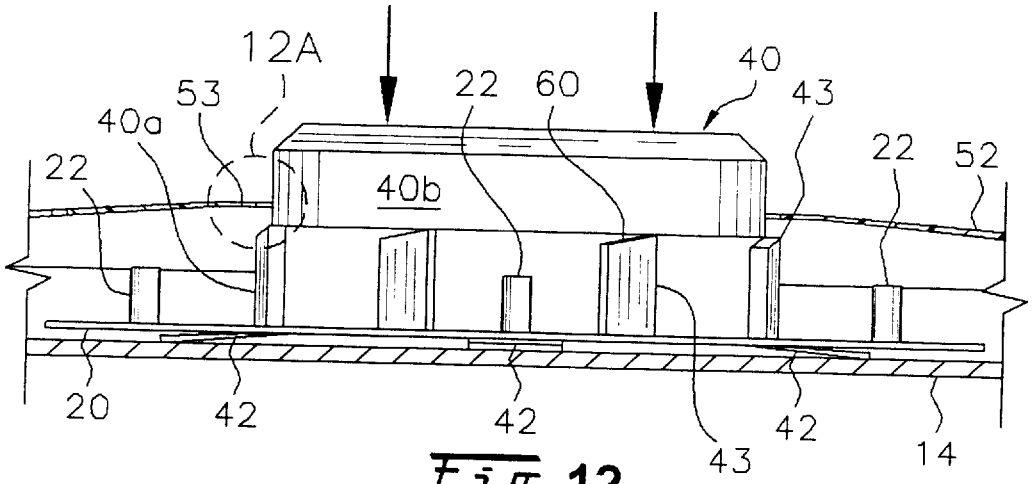
FIG. 12 is an enlarged fragmentary sectional view similar to FIG. 11 showing the operation of the alternate embodiment.
Figure 12A:
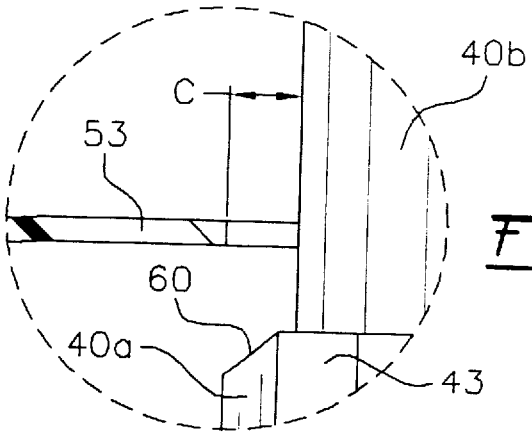

As shown in FIGS. 11 and 12, the dial (40) comprises a lower portion (40*a*) having a series of axially extending radially outwardly projecting teeth (43) of generally square or rectangular cross section and an upper portion (40*b*) of smaller diameter (D1) than the diameter (D2) of a circular trace through the outer periphery of the teeth (43). As shown in FIG. (10*a*), the teeth (53) on the central opening formed in the top of the housing are of a configuration to mesh with the dial teeth (43) when the dial is in its normal position (See FIG. 11). When an axially downward force is applied to the dial, the spring like fingers (42) comply to thereby lower the dial (40) in the housing to a point where the top teeth (53) are aligned with the upper portion of the dial to permit free rotation of the dial (40) to rotate the blister pack. Note that in this position, there is a clearance (C) between the top teeth (53) and the outer generally cylindrical peripheral upper portion (40*b*) of the dial. Note that the teeth (53) at the point of juncture at the upper end at the point of juncture with the top portion of the dial are somewhat beveled as at (60) to serve as a pilot and guide the teeth (43) and (53) into intermeshing engagement when the axially pressure is released to position it in its normal child resistant position as shown in FIG. 11.

Even though particular embodiments of the present invention have been illustrated and described herein, it is not intended to limit the invention and changes and modifications may be made therein within the scope of the following claims.

What is claimed is:

1. A child resistant pill package assembly comprising a base member and a top member spaced apart to define a hollow interior, a dial mounted on a platform for an annular pill pack assembly having a lower portion and a upper portion which projects though an opening in the top, means defining a plurality of radially outwardly circumferentially spaced teeth on the lower portion of the dial, a series of complementary teeth which project radially inwardly from the circular opening in the top and which mesh with the teeth on the lower portion of the dial when aligned therewith and flexible spring fingers normally biasing the dial outwardly so that the dial teeth and top teeth are in meshing relationship, application of pressure on the dial downwardly displaces the spring fingers so that the teeth are disengaged and confront the upper portion to permit rotation of the dial and pill pack.

2. A child resistant pill package assembly comprising a base member and a top member spaced apart to define a hollow interior, a dial mounted on a platform for an annular pill pack assembly having a lower portion and a upper portion which projects though an opening in the top, means defining a plurality of radially outwardly circumferentially spaced teeth on the lower portion of the dial, a series of complementary teeth which project radially inwardly from the circular opening in the top and which mesh with the teeth on the lower portion of the dial when aligned therewith and means for discharging one pill at a time at a discharge opening in one of said members.

* * * * *